US010513046B2

(12) United States Patent
Bussell

(10) Patent No.: US 10,513,046 B2
(45) Date of Patent: Dec. 24, 2019

(54) CD/DVD GUILLOTINE DESTRUCTION DEVICE

(71) Applicant: Jeffrey A. Bussell, West Bloomfield, MI (US)

(72) Inventor: Jeffrey A. Bussell, West Bloomfield, MI (US)

( * ) Notice: Subject to any disclaimer, the term of this patent is extended or adjusted under 35 U.S.C. 154(b) by 0 days.

(21) Appl. No.: 16/134,098

(22) Filed: Sep. 18, 2018

(65) Prior Publication Data

US 2019/0084173 A1 Mar. 21, 2019

Related U.S. Application Data

(60) Provisional application No. 62/560,476, filed on Sep. 19, 2017.

(51) Int. Cl.

| | |
|---|---|
| ***B26D 5/10*** | (2006.01) |
| ***B26D 3/30*** | (2006.01) |
| ***B26D 1/08*** | (2006.01) |
| *B26D 7/00* | (2006.01) |

(52) U.S. Cl.

CPC ..... *B26D 3/30* (2013.01); *B26D 1/08* (2013.01); *B26D 5/10* (2013.01); *B26D 2007/0018* (2013.01)

(58) Field of Classification Search

CPC .... B26D 1/08; B26D 2007/0018; B26D 3/30; B26D 5/10; B26D 1/30; B23D 17/08; Y10T 83/8809; Y10T 83/8812; Y10T 83/8815; Y10T 225/379

See application file for complete search history.

(56) References Cited

U.S. PATENT DOCUMENTS

| | | | | |
|---|---|---|---|---|
| 1,881,020 | A | 10/1932 | McFarland | |
| 5,431,078 | A * | 7/1995 | Ricard | B26B 29/063 83/454 |
| 6,039,637 | A | 3/2000 | Hutchison et al. | |
| 6,334,582 | B1 | 1/2002 | Castronovo | |
| 6,722,240 | B1 | 4/2004 | Weng | |
| 7,134,940 | B2 | 11/2006 | Hutchison et al. | |
| 7,374,114 | B1 | 5/2008 | Pekay et al. | |

(Continued)

FOREIGN PATENT DOCUMENTS

| | | | |
|---|---|---|---|
| CN | 202951699 U | * | 5/2013 |
| DE | 10061321 A1 | | 6/2002 |

(Continued)

*Primary Examiner* — Stephen Choi

(57) ABSTRACT

A guillotine style destruction device for severing one or more data carrying disks including a body having an extending passageway defined therein and a disk containing cartridge or support incorporated or positioned within the body and for supporting the disks in intersecting fashion relative to an interior passageway. A handle supports a blade, and is guidably supported relative to the body for displacing the blade within the passageway for incising the disks. The body includes a disk supporting tray at an upper end and, optionally, an incised disk removal tray, drawer or collection receptacle at a bottom end. The blade can be incorporated into either of a pivoting or vertically descending handle and, upon inserting one or more CD's or disks associated with the upper tray, incises the disk to assist traveling into the lower deposit and removal area.

9 Claims, 16 Drawing Sheets

(56) References Cited

U.S. PATENT DOCUMENTS

| | | | | |
|---|---|---|---|---|
| 7,937,982 | B2 | 5/2011 | Aoki et al. | |
| 2003/0197453 | A1* | 10/2003 | Jurja | A47B 88/57<br>312/334.46 |
| 2004/0014404 | A1 | 1/2004 | Miller | |
| 2004/0125722 | A1 | 7/2004 | Feehan et al. | |
| 2005/0054271 | A1 | 3/2005 | Hutchison et al. | |
| 2005/0132394 | A1 | 6/2005 | Rotelli | |
| 2007/0284367 | A1 | 12/2007 | Lin | |
| 2009/0120260 | A1 | 5/2009 | Hutchison et al. | |
| 2017/0224190 | A1* | 8/2017 | Sakthivel | A47L 15/506 |

FOREIGN PATENT DOCUMENTS

| | | | | |
|---|---|---|---|---|
| GB | 2420993 | A * | 6/2006 | B26F 1/02 |
| WO | 2011029442 | A1 | 3/2011 | |

* cited by examiner

CD/DVD GUILLOTINE DESTRUCTION DEVICE

CROSS REFERENCE TO RELATED APPLICATIONS

The present application claims the priority of U.S. Ser. No. 62/560,476, filed Sep. 19, 2017.

FIELD OF THE INVENTION

The present invention relates generally to a device for destroying individual or stacked pluralities of CD's DVD's. More specifically, the present invention discloses a guillotine style destruction device which includes a downwardly descending blade for severing any plurality of CD's/DVD's supported in a crosswise positioned manner upon a pedestal supporting body of the device, the same further including a vertical passageway for at least partially receiving the incising portion of the blade.

BACKGROUND THE RELEVANT ART

The prior art is documented with splitter destruction devices, such as which can be used in the effective destruction of digital data containing disks (CD Rom, optical disks, etc.). A first example of this is depicted in US 2009/0120260, to Hutchison, which teaches a manual DVD splitter for destroying or disabling an information or data storage device. The splitter includes a first layer and a second layer bonded together. A mechanical is inserted into the data storage device in order to cause the first and second layers to separate from each other.

DE 100 61 321 teaches another type of method and device for the manual/mechanical destruction of data recorded on a CD and so that the CD cannot be read by a CD-ROM device in a computer. This is accomplished through the formation of a number of holes in the surface of the CD via a guillotine device with a series of spikes (C) for perforation of the CD.

A further type of guillotine apparatus, such as which is associated with slicing of a food article (bagel) is disclosed in U.S. Pat. No. 5,431,078 to Ricard which teaches a receptacle for holding the bagel (such being vertically arrayed). A blade holder with a blade, a handle and a pair of blade guarding walls is provided. The food holder has a base and a pair of spaced vertical receptacle walls extending upwardly from the base forming a pair of opposed vertical slots. The blade holder has a handle, a pair of spaced transparent blade guarding walls surrounding and guided along the vertical walls of the food holder, and a blade having a pair of serrated cutting edges intersecting one another. The blade is arranged and dimensioned to ride in the vertical slots and to traverse the central part of the receptacle when the handle is vertically actuated to slice the food article, during which the bagel is held by a cradle which has blade protection lips to guard the blade cutting edge at the lower travel limit.

SUMMARY OF THE PRESENT INVENTION

The present invention discloses a guillotine style destruction device for severing one or more data carrying disks and including a body having an extending passageway defined therein, and a tray incorporated into the body and adapted for supporting the disks in intersecting fashion relative to the passageway. A handle supports a blade, and is guidably supported upon the body for displacing the blade within said passageway for incising the disks.

In one variant, the body includes a rectangular enclosure supporting both the disk supporting tray at an upper end and an incised disk removal tray or drawer at a bottom end. The blade in this variant is incorporated into a pivoting handle and, upon inserting one or more CD's or disks associated with the upper tray, a laterally displaceable support component grips an edge location of the disk following installation of the upper tray, the support component is influenced by the downwardly displacing handle in combination with the incising blade in order to outwardly deflect out of contact with the disk edge and to release the severed halves of the disk to assist their traveling into the lower collection tray.

In a further non-limiting variant, the body is constructed with a central vertical chamber for supporting the disk supporting insertion tray. The handle further includes a central portion interconnecting a pair of downwardly extending side portions, with the blade further connected to and extending between the side portions.

In either variant, the blade can include a serrated edge and first and second angled sides. The tray may further include first and second split shelf supports or other portions which are separated by the passageway to assist in the passage therebetween of the incising blade. Either version further includes a type of pillar or vertical support to permit the blade to displace along and within the passageway between an upper set position and a lower most displaced and incising position.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

With reference to the attached illustrations, the present invention discloses a pair of versions, at 10 (FIGS. 1-14) and further at 150 (FIGS. 15-21) respectively, of a guillotine style destruction device for quickly incising and rendering unreadable the date stored on digital storage and replay disks or devices, these including but not limited to any type of DVD, CD or other digital data storage disk, further depicted in one piece at 2 and incised/separated sections at 2' throughout the illustrations. In particular application to document destruction protocols, the present invention enables the ability to quickly destroy any plurality of digital readable disks with similar efficiencies accorded to larger scale document destruction provided by paper shredders.

Figure 1:
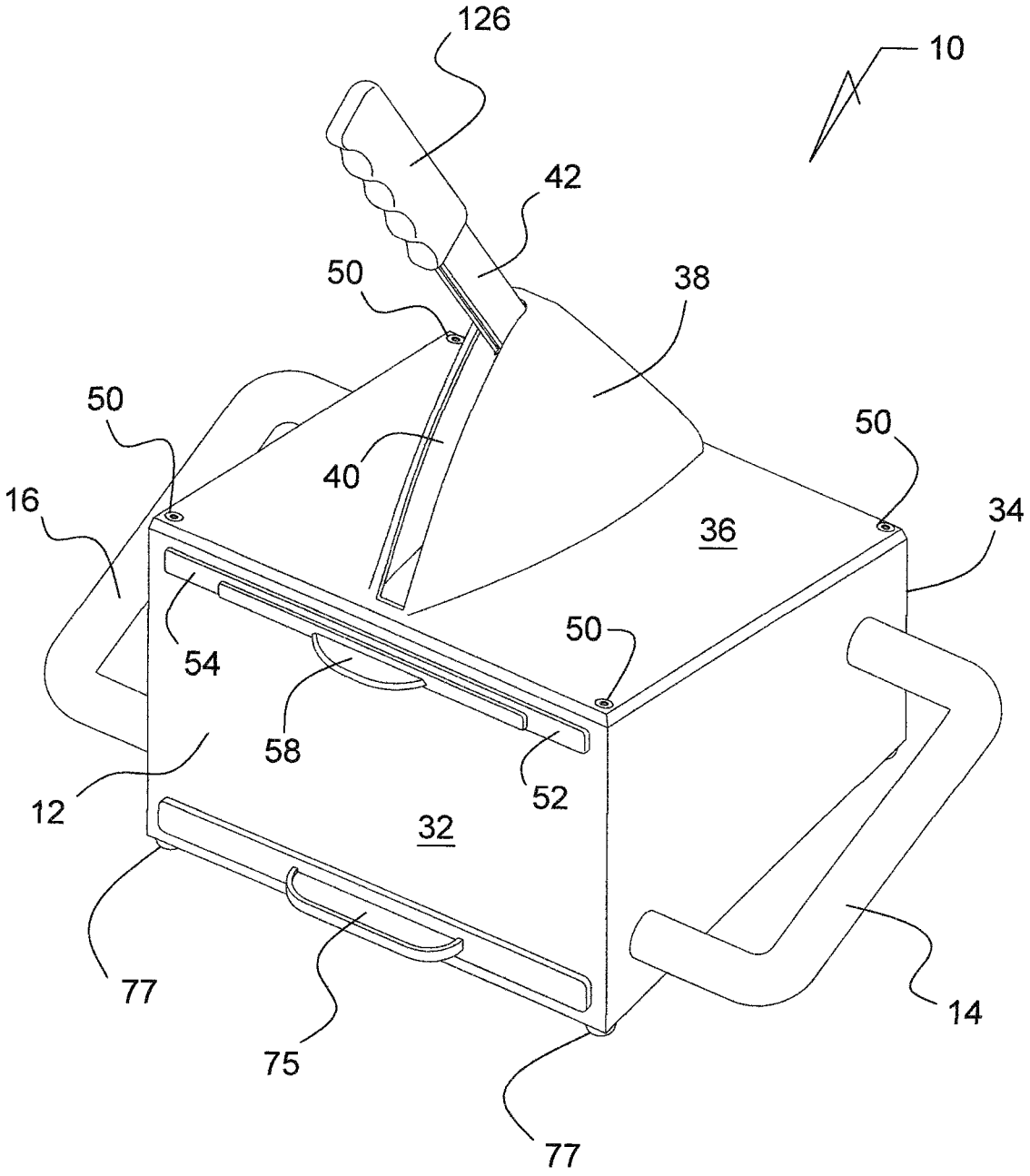
FIG. 1 is a perspective view of a CD/disk destruction device according to a first embodiment including body includes a rectangular enclosure supporting both the disk supporting tray at an upper end and an incised disk removal tray or drawer at a bottom end, the blade in this variant is incorporated into a pivoting handle and, upon inserting one or more CD's or disks associated with the upper tray, a laterally displaceable and pre-incising disk support component is influenced by the downwardly displacing handle in combination with the incising blade in order to displace out of contact with an edge of the disk concurrent with its incision/severing and to assist release of the severed disks into the lower collection tray.
Figure 2:
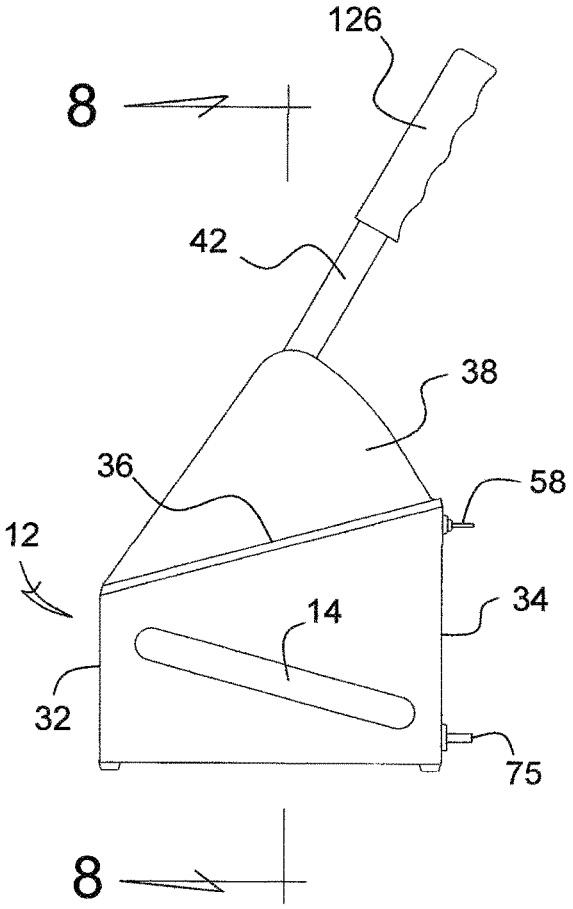
FIG. 2 is a right side view of the device of FIG. 1.
Figure 3:
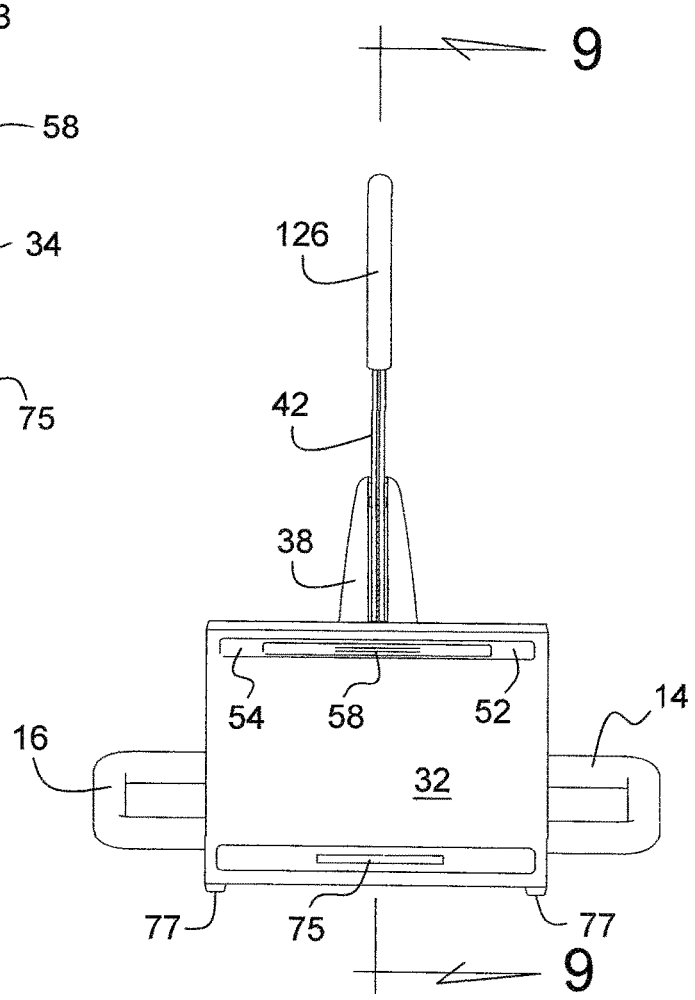
FIG. 3 is a front view of the device of FIG. 1.
Figure 4:
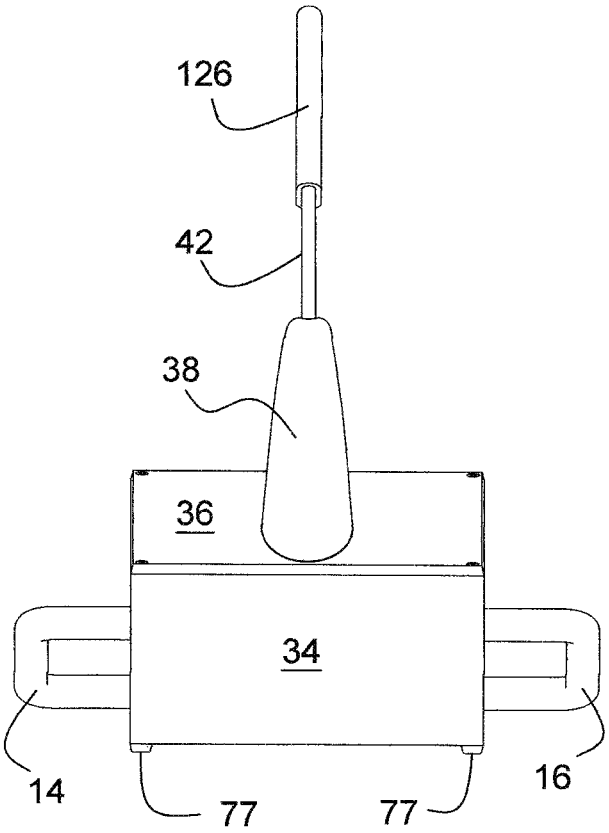
FIG. 4 is a rear view of the device of FIG. 1.
Figure 5:
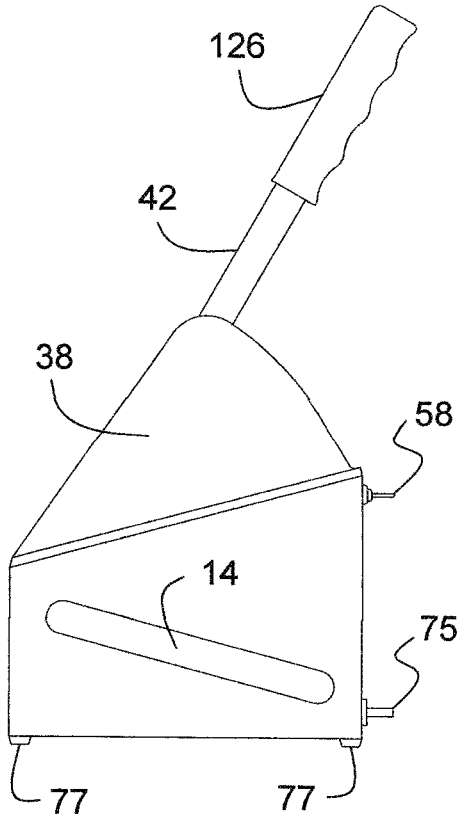
FIG. 5 is a left side view of the device of FIG. 1.

FIG. 1 is a perspective view of a CD/disk destruction device, again generally at 10, according to a first embodiment. As further referenced by the part exploded view of FIG. 14, the device includes a rectangular enclosure 12 with a pair of "U" shaped hand holds 14 and 16 secured to opposite sides of the enclosure via pairs of bolts 18 and 20 which insert through side located aperture pairs 22 and 24 from inside locations of the enclosure 12 and engage interiorly threaded end locations of the hand holds (see further at 26 for selected hand hold 16).

A pair of upper 28 and lower 30 horizontal slot shaped recesses are configured within the front face of the enclosure 12. As further shown throughout FIGS. 1-14, the opposite sides of the enclosure 12 are tapered at a downward angle between front face 32 and rear face 34. A planar lid 36 includes a generally triangular shaped integrated portion 38 defining a front slot 40 through which projects a handle 42 forming a part of a pivotally supported incising linkage. A plurality of four corner apertures (three of which are shown at 44, 46, and 48) in FIG. 14 receive inserting fasteners 50 for securing the lid over the open top of the enclosure.

A disk supporting tray assembly is configured for securing through the upper front face slot 28 and includes a planar shaped disk receiving insert cartridge which is constructed as a pair of laterally separable portions 52 and 54 which are recessed notched at 55 at their rear joining edges. The insert portions 52/54 each define an open underside and an insertion slot 56 is defined in a common front edge. As further shown in FIG. 14, the insert portions 52/54 are supported upon inward ledges (a pair of which are visible at 51 and 53 in FIG. 14) extending inwardly around the upper interconnecting edges of the enclosure in FIG. 14 and so that the disk supporting tray assembly is both supported at the upper enclosure and allowed to laterally split to a degree necessary to allow passage therebetween of the pivotally supported and descending incising blade, the interior of the enclosure 12 defining a passageway revealed by the incremental displacement of the split portions 52/54 to permit incising travel of the blade.

The disk 2 is supported by a front guide 58 having an arcuate inner edge 60 (see also FIG. 12) and so that, upon installing the disk 2 and supporting guide 58 within the insertion slot, the disk is supported within the open underside of the laterally split portions 50/52. As will be further discussed, a laterally displaceable component 62 is spring loaded at a pivot mount location 64 (see pin 66 and torsional spring 68) to a mounting location (aperture 70) of a selected separable portion 52.

A leg 72 of the disk supporting component 62 is supported within an elongated channel 74 with an underside securing collar 76 associated with the selected separable portion 52 and so that, in a pre-actuated position the supporting component 62 biases the separable portions 52/54 together, with the collar optionally also biasing into contact with an edge of the pre-incised CD/disk 2. As will be further described, the downward incising motion of the pivoting handle 42 results in engagement and outward lateral displacement of the component 62 (via a configured edge 63 of the component 62 best shown in FIG. 13 and which is contacted by the handle 42 during its downward arc), and which in turn separates the split portions 50/52 at their common joined edges to simultaneously allow concurrent passage of the handle supported blade and incising fracturing and downward release of the disk 2.

Figure 14:
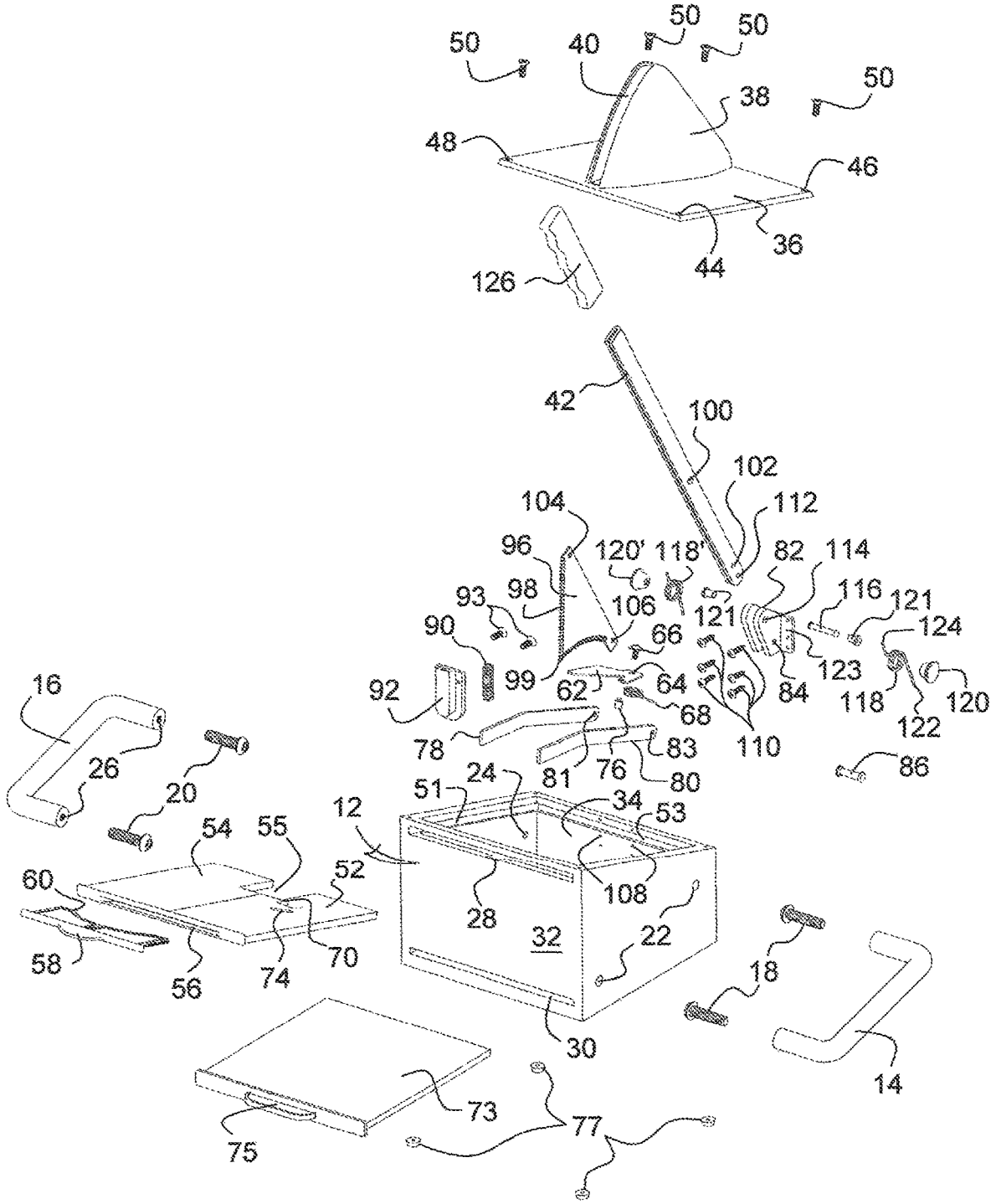
FIG. 14 is an exploded parts list view of the disk destruction device of FIG. 1.
Figure 15:
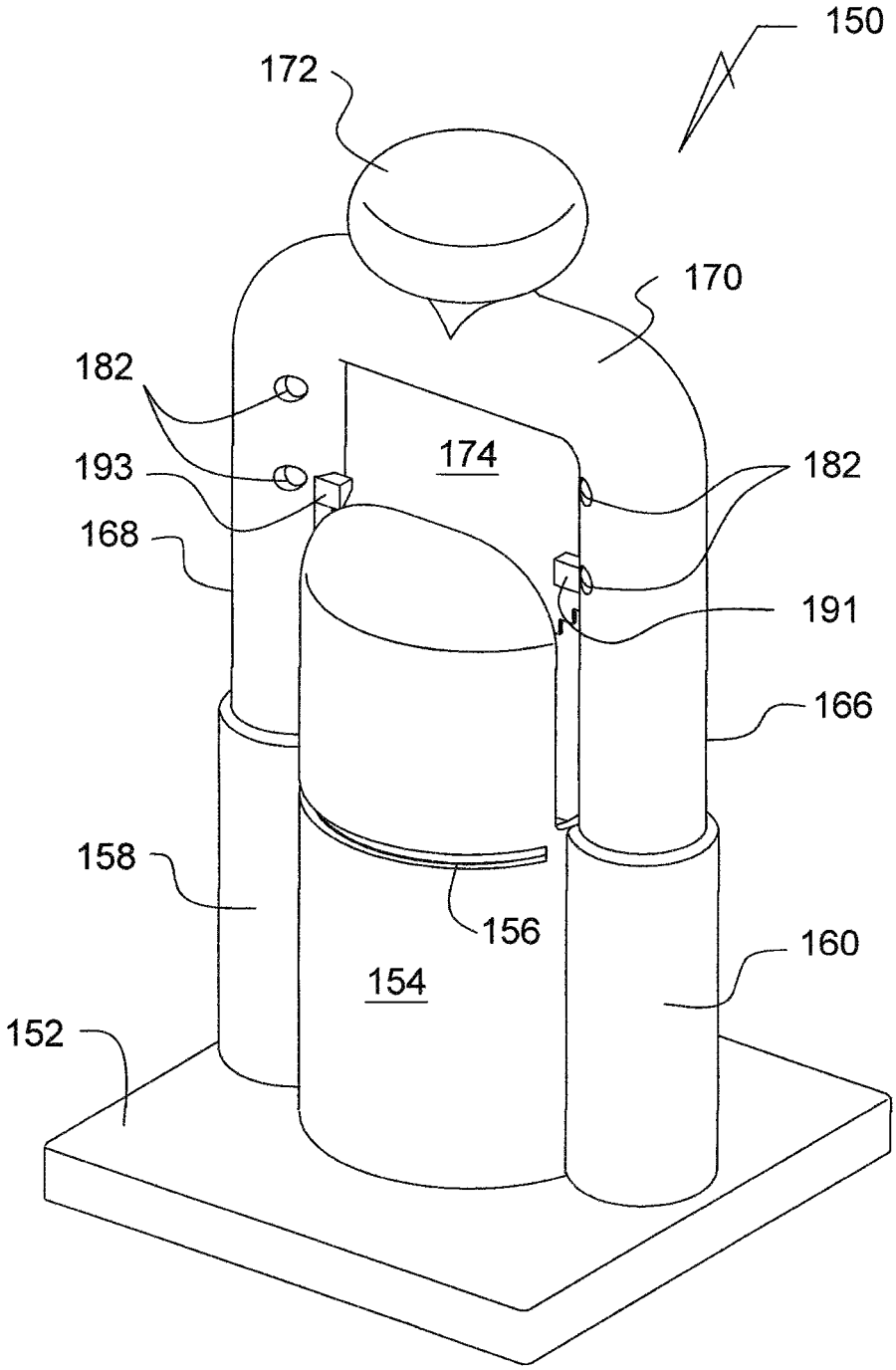
FIG. 15 is an assembly view of the disk destruction device according to a further non-limiting embodiment of the present invention and including a body constructed with a central vertical chamber for supporting the disk supporting insertion tray, a redesign of the handle further including a central portion interconnecting a pair of downwardly extending side portions, with the blade further connected to and extending between the side portions.
Figure 16:
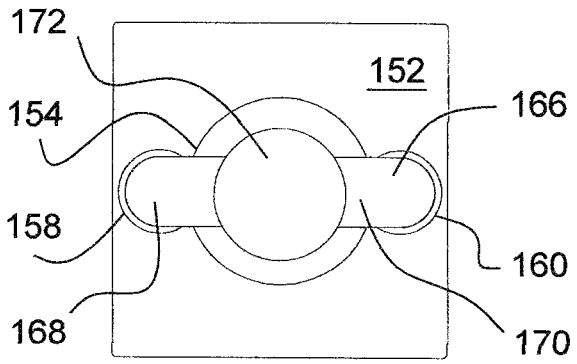
FIG. 16 is a top view of the device of FIG. 15.

A fractured disk collection and removal tray 73 is shown for seating within the lower slot 30. A forward gripping portion 75 allows the tray 73 to be both seated within and removed from the lower slot 30. Also shown at 77 in FIG. 14 are a plurality of pedestal stand-offs which secure to bottom corner locations of the enclosure underside 12.

A pair of angled linkage arms 78 and 80 are pivotally mounted at rear locations 81 and 83 to a bracket 82, such including aligning the arms a lower pair of aligning apertures 84 in the bracket 82, via a support collar 86. A guide pocket 92 is secured to an inside surface of the enclosure 12 (via mounting fasteners 93), a coil spring 90 seating within the pocket and in contact with an underside location of a selected linkage arm 78 and so that, upon downward incising pressure of the pivotal handle 42 and associated mounted blade, the laterally split CD/disk 2, is supported upon the upper surfaces of the linkage arms 78/80 during a limited pivotal biased displacement of the linkage arms during incised fracturing of the disk, and concurrent with the linkage arms being pivoted during the pre and post incising positions of FIGS. 6-7.

An incising blade is depicted by pseudo triangular shaped portion 96 which can include first and second angled sides with serrated edge patterns 98 which define an engaging and incising tip 99. The blade 96 is mounted to the handle 42 at mounting locations 100 and 102 which align with locations 104 and 106 via rivets, fasteners or the like. The support bracket 82 is secured to an aperture pattern 108 in the rear upper location of the rear face of the enclosure 12, via a further plurality of fasteners 110.

A base end of the handle 42 includes a further mounting aperture 112 which aligns with a further pair of apertures 114 defined in the spaced apart ears of the bracket 82. A pin 116 inserts through the aligning pairs of apertures 112/114. The handle 42 is biased upwardly in the design (pre-incising position) by a pair of torsional springs 118 and 118' which are mounted about the pin 116 by opposite end caps 120 and 120', see also support collars 121 and 121'. A first leg 122 of each torsional spring (referencing spring 118) biases an end flange 123 of the bracket 82, with a second opposite leg 124 biasing against an underside surface of the handle 42 in order influence the handle 42 upwardly absent a downward pivoting force exerted by a user. An ergonomic grip 126 is also mounted to an upper end of the handle 42 projecting from the lid 36 and superstructure 38.

As illustrated throughout the illustrations, the blade 96 in this variant is incorporated into the pivoting handle 42 and so that, upon inserting one or more CD's or disks 2 associated with the upper loading tray (inserting support portion 58 and loading cartridge with separable portions 52/54, downward pivoting motion of the handle 42 (against the counter biasing upward force exerted by the torsional springs 118/118') causes the pointed tip 99 of the blade 96 to arc in a direction towards the disk 2 supported between the separable portions 52/54 of the upper tray cartridge.

Concurrent downward motion of the handle 42 just prior to and during incision of the disk 2 causes it to contact with the configured edge 63 of the outwardly displaceable component 62 (again FIG. 13) which is mounted to the separable portion 52. As also shown in FIGS. 9-10, outward pivoting of the component 62 both causes the lateral portions 52/54 of the cartridge to separate along their joining line so that the portions 52/54 are allowed to slide incrementally in opposite outward directions upon the upper inner shelf extending ledges 51/53 of the enclosure (thereby allowing passage therebetween of the incising blade 96).

As previously described, the pre-incised disk 2 is supported within the open underside of the cartridge portions 52/54, both resting upon the linkage arms 78/80 and further supported in edge contact by the underside pin supported collar 76 of the slot mounted portion of the lateral component 62. In this fashion, incremental outward pivoting of the component 62 (see again both pre and post positions in FIGS. 9 and 10) concurrently results in the underside collar releasing from a biasing contact with the disk (resulting from the outward displacement of the component 62 countering the inward supporting and biasing force exerted by the torsional spring 68 associated with the component 62).

Figure 6:
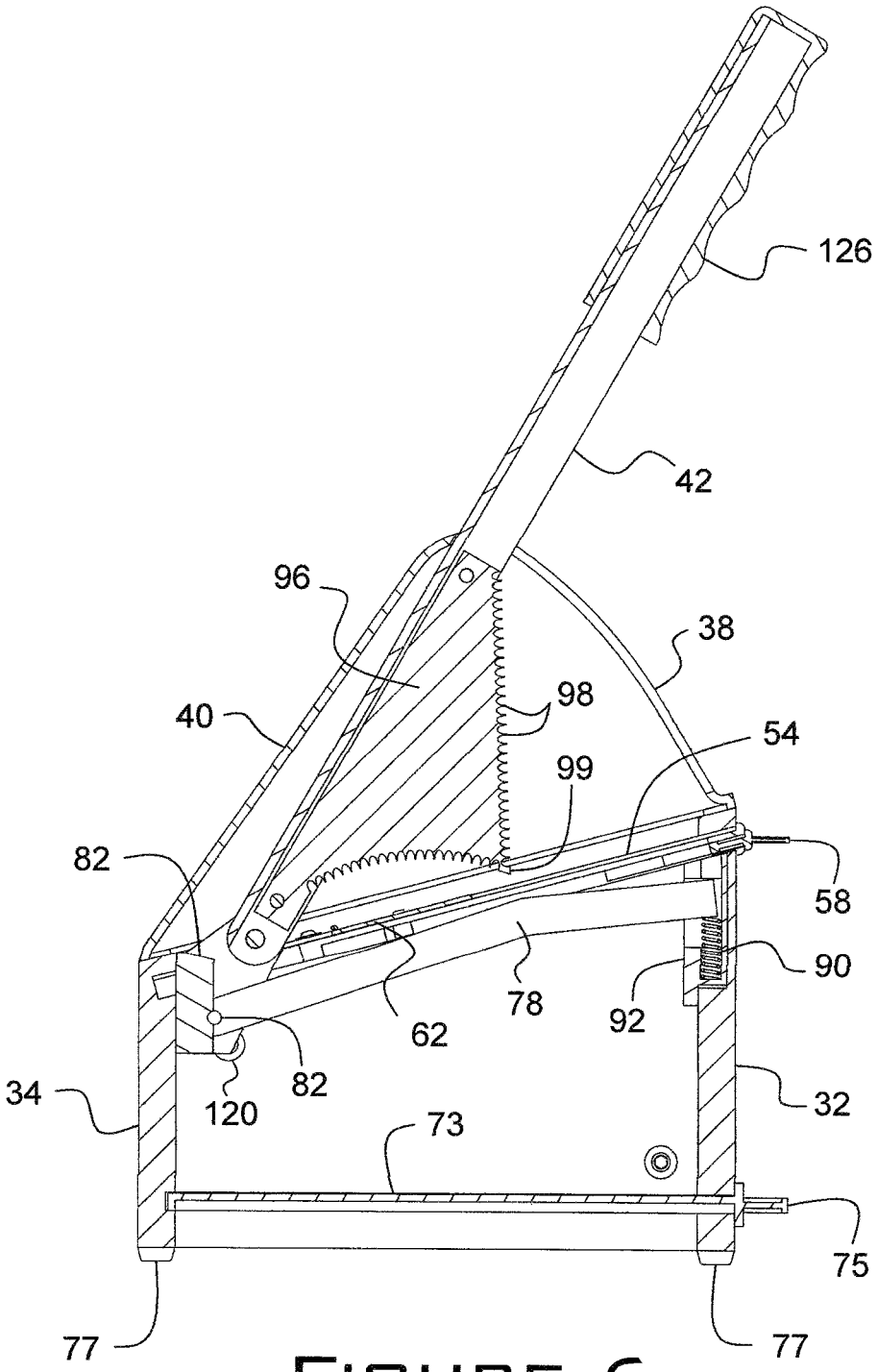
FIG. 6 is a middle vertical cutaway of the device of FIG. 1 and better illustrating the interior components including the pivoting handle, incising blade, disk supporting tray and lower collection interior.
Figure 7:
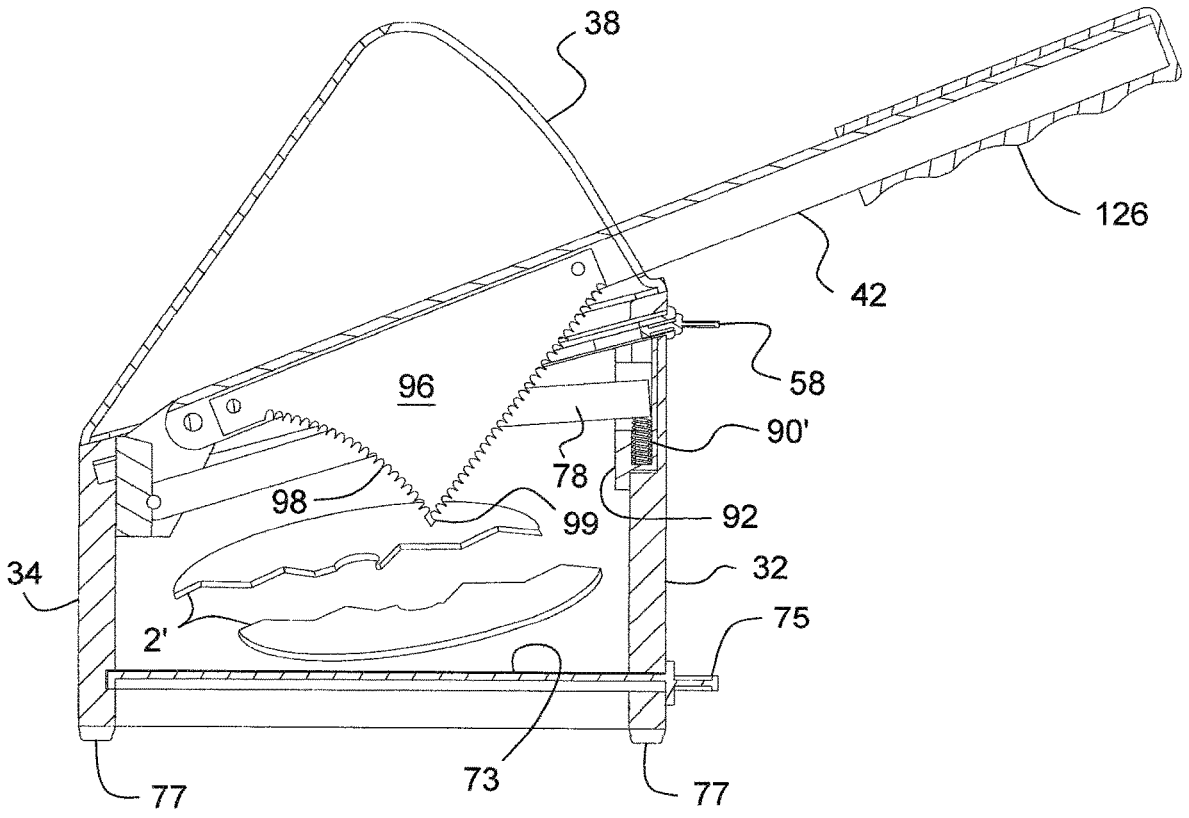
FIG. 7 is a succeeding view of FIG. 6 depicting the handle and blade in a downwardly pivoted position in which the blade has incised the disk.
Figure 8A:
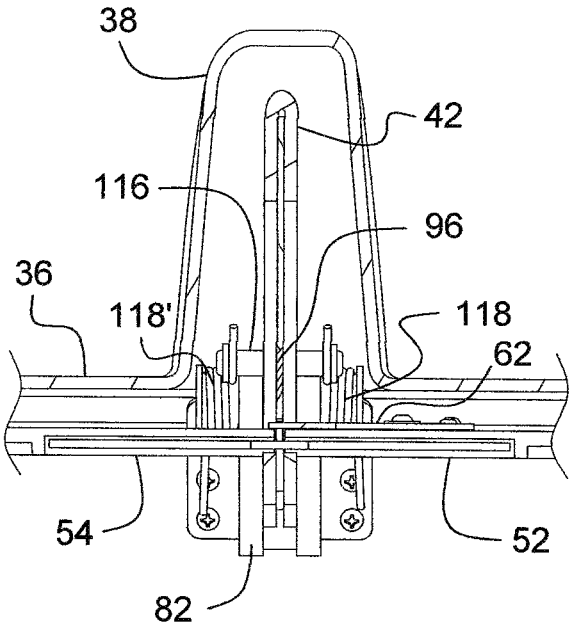
FIG. 8A is an upper cutaway end view of the handle, blade and upper portion of the enclosure corresponding to FIG. 6 and the cutaway direction of arrow 8-8 of FIG. 2 shown in a pre-incising position.
Figure 8B:
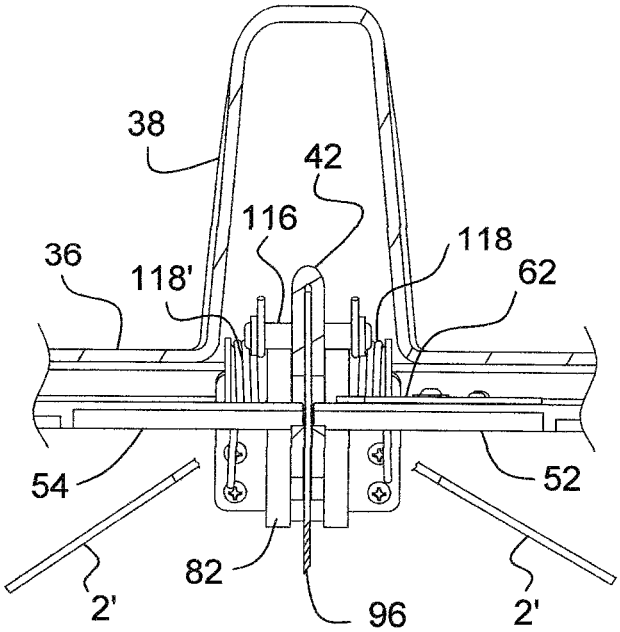
FIG. 8B is a succeeding illustration to FIG. 8A corresponding to the post-incising position of FIG. 7.
Figure 9:
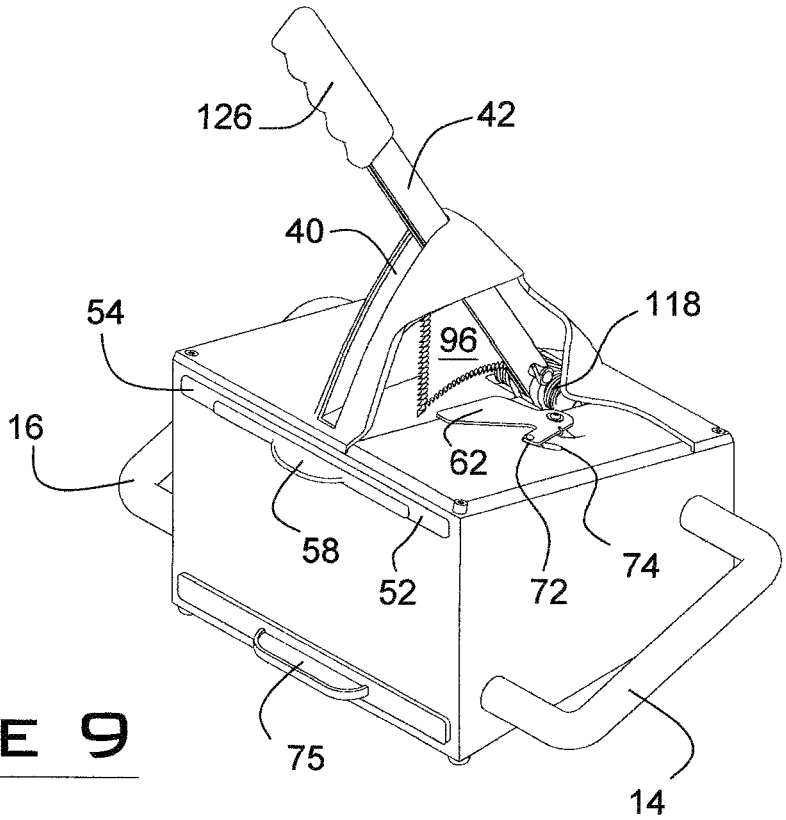
FIG. 9 is an illustration similar to FIG. 1 and the cutaway direction of arrow 9-9 of FIG. 3 illustrating the upper housing portion of the enclosure in partial cutaway in the pre-incising position of FIGS. 6 and 8A and further depicting the handle actuating and laterally displacing component in an initial position.
Figure 10:
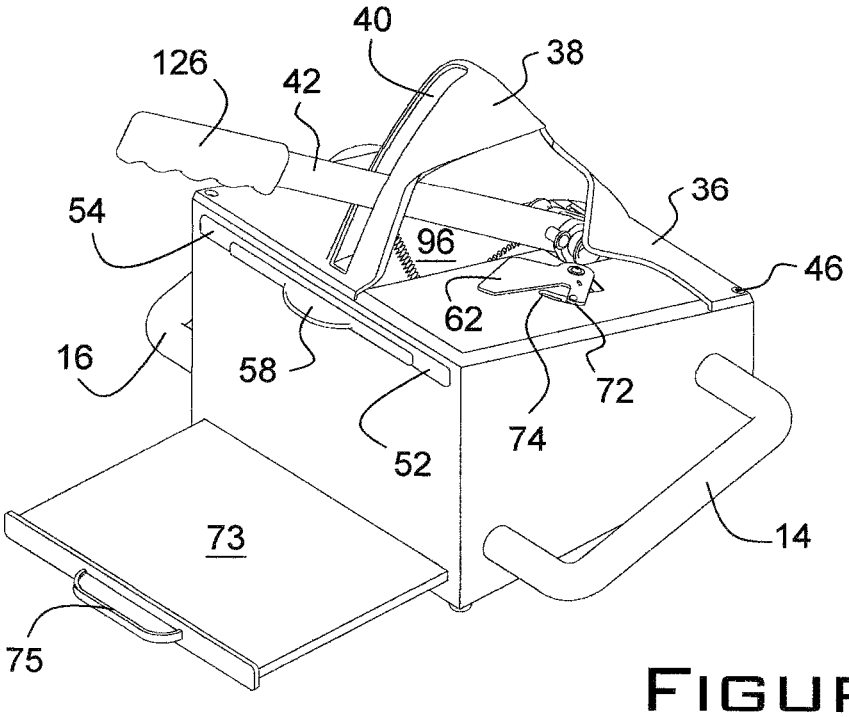
FIG. 10 is a succeeding illustration to FIG. 9 corresponding to the post-incising position of FIGS. 7 and 8B and in which the component is displaced to a fully lateral position corresponding with disk incision.
Figure 11:
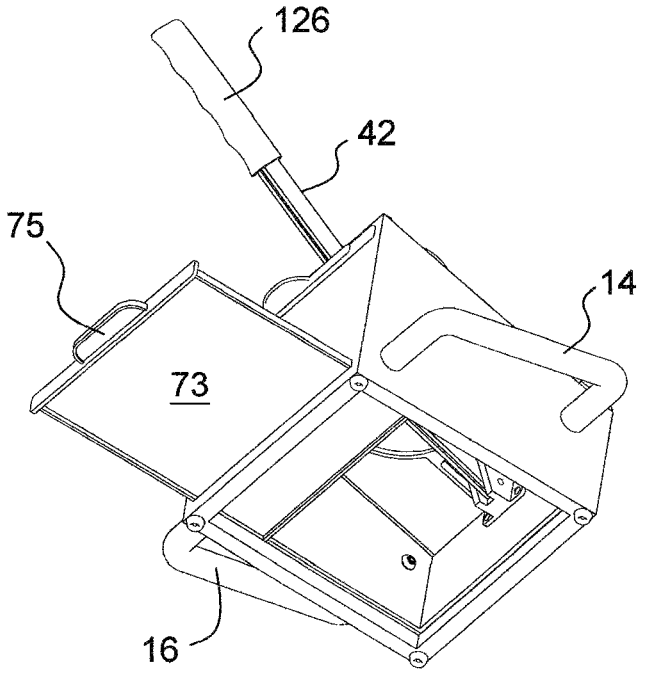
FIG. 11 is an underside perspective view of the disk destruction device of FIG. 1 and illustrating the forward sliding removal of the lower incised disk collection tray.
Figure 12:
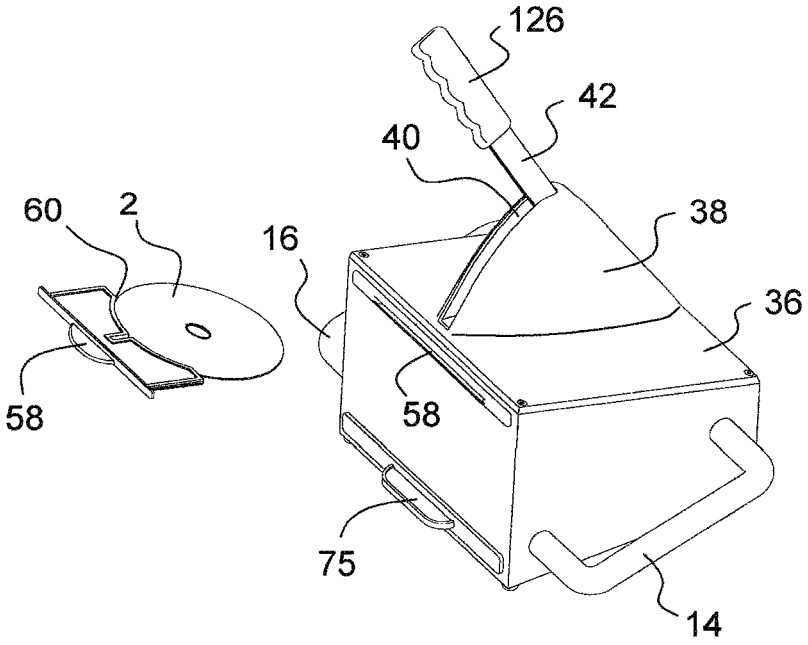
FIG. 12 is a view similar to FIG. 1 and illustrating the disk supporting collection tray separated from an upper slot defined in the housing enclosure in centered proximity to the downwardly pivoting handle and incising blade.
Figure 13:
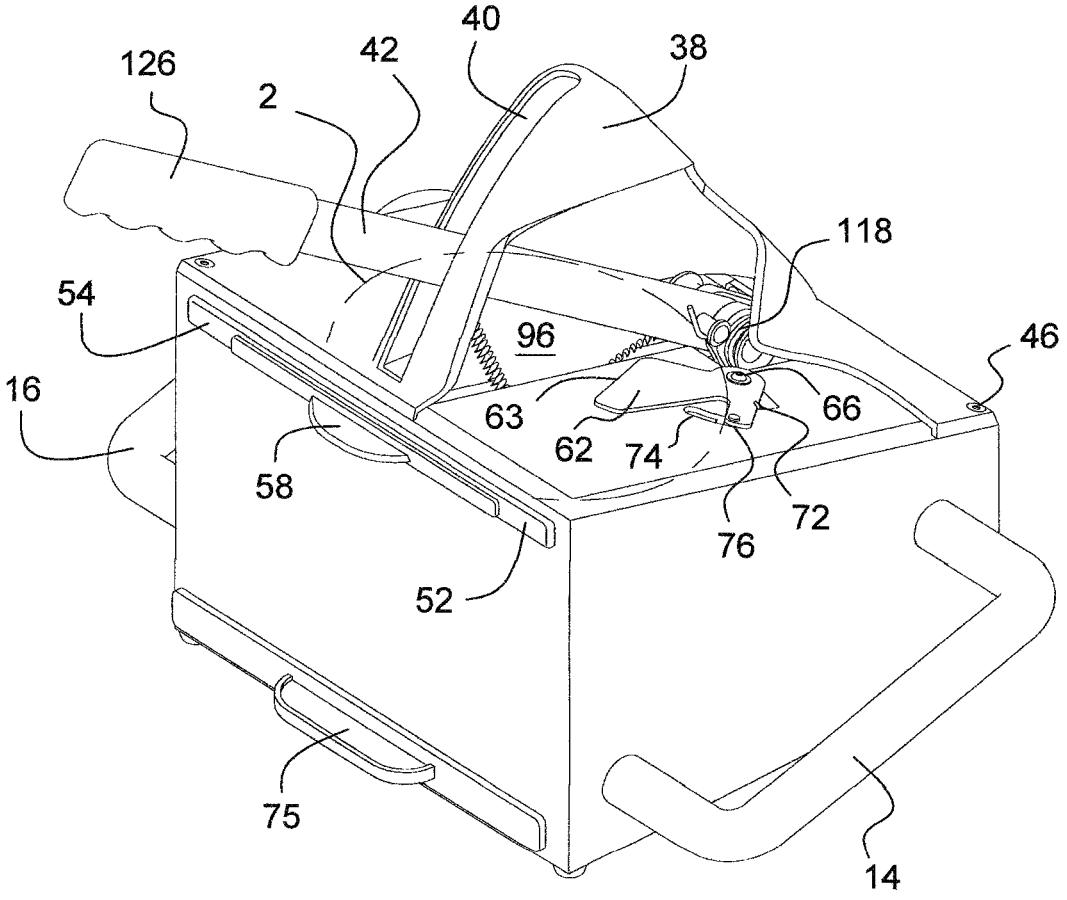
FIG. 13 is an enlarged view similar to FIG. 10 and illustration the support component laterally displaced from edge contact with the disk to the post incising and release position for permitting the disk (depicted in phantom) to descend into the collection tray upon being severed.

At this point, the tip 99 of the blade 96 contacts the disk 2, this again shown by pre and post incising progressions in each of side cutaway (FIGS. 6-7), front cutaway (FIGS. 8A-8B) and perspective cutaway (FIGS. 9-10). As best shown in FIGS. 6-7, the linkage arms 78/80 are incrementally pivoted downwardly in response to the pressing and incising motion of the blade 96 (see compression of coil spring 90 in FIG. 6 to position 90' in FIG. 7), with the cartridge loading portions 52/54 incrementally separating along their common joining line during the blade incision and passage therebetween of the blade in its downward most arc position (again FIG. 7). As previously described, concurrent outward-most displacement of the lateral supporting component 62 completes disengagement from the severed disk portions 2', thus allowing the severed pieces to descend into the lower collection tray 73. Upon completion of the downward incising stroke (again FIG. 7) releasing motion on the handle 42 results in reverse upward return motion of the handle and blade 96, with the cartridge portions 52/54 rejoining inwardly along their common edge due to the return biasing motion of the displaceable component 62 and its associated torsional spring 68. Once returned to the pre-incising position of FIG. 6, a successive disk or disks 2 can be loaded into the upper inserting cartridge in the manner previously described.

Figure 22:
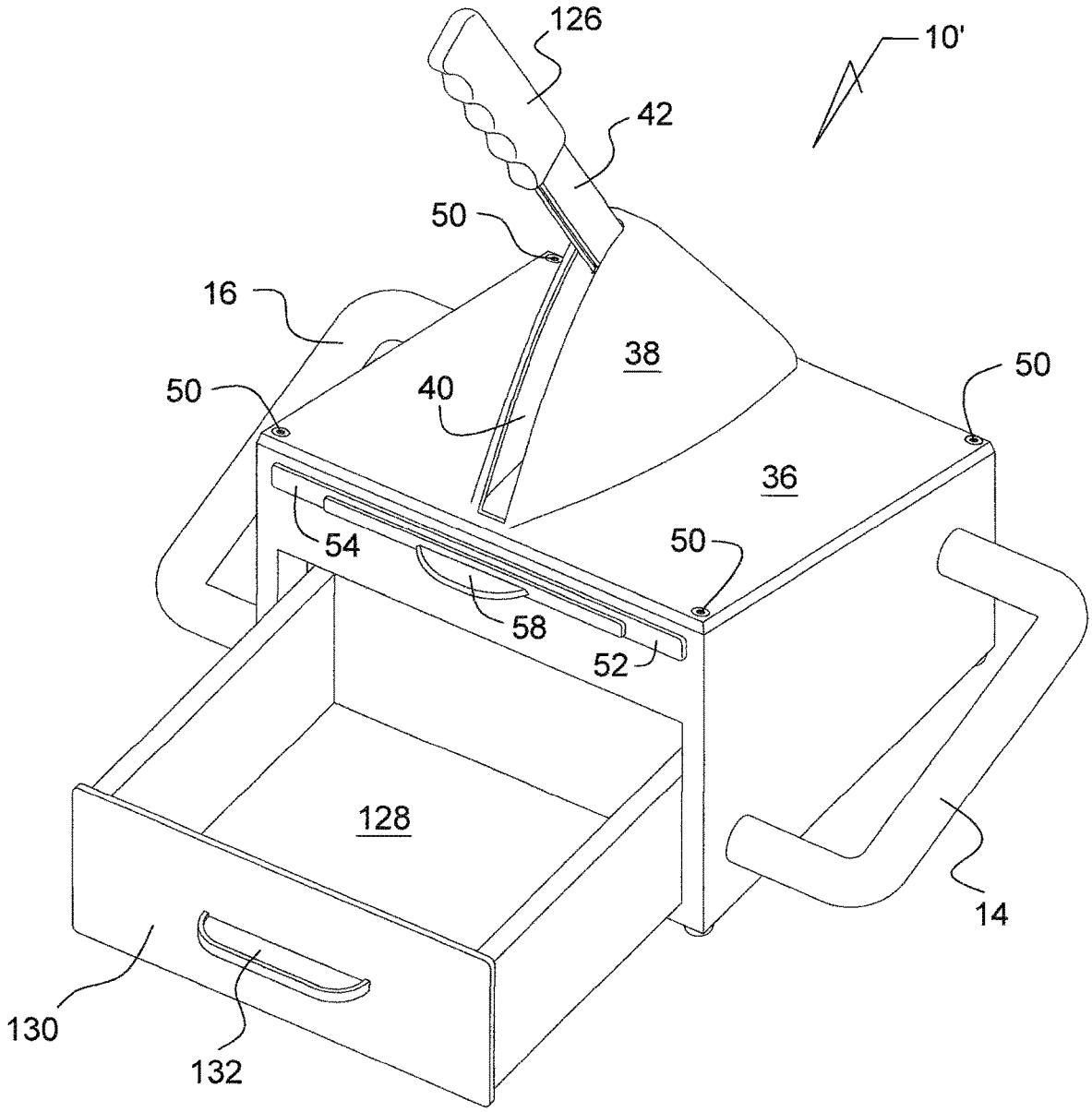
FIG. 22 is an illustration of an alternate disk destruction device similar to FIG. 1 and illustrating a pullout drawer incorporated into the enclosure for removal of the incised disk portions.

FIG. 22 is an illustration of an alternate disk destruction device 10' similar to that shown at 10 FIG. 1, with all common components identically numbered, and illustrating a pullout drawer 128 incorporated into the enclosure for removal of the incised disk portions and in substitution of the lower removal tray 73 with ergonomic forward gripping edge 75 shown in FIGS. 1-15. The depth defining removal drawer is shown outwardly displaced from the main enclosure and includes a front drawer face 130 with a gripping location 132. As further shown, the configuration of the drawer provides the ability to section and store larger numbers of disks, as compared to the tray 73, and prior to removal and disposal.

Proceeding to FIGS. 15-21, a further variant 150 is shown of the guillotine style destruction device includes a pedestal supporting body including a bottom platform 152 which supports and an upwardly extending three dimensional main body portion 154. With reference initially to the exploded parts list of FIG. 21, the main body 154 is constructed with a central vertical chamber, such having any three dimensional shape including a cylindrical outline matching the any plurality of horizontally stacked disks 2. The upper superstructure of the main body 154 is split open by spaced apart opposing side edges 155 and 155' which extend to intermediate side locations of the main body. A slot 156 is configured at an intermediate elevated location in the central or main chamber 154, as shown just below the split side edges 155/155', and is sized to receive one or more inserted disks 2 to be destroyed. The shape and configuration of the passageway configured between the split side edges 155/155' can be varied according to the profile and dimensions of the associated and vertically displaceable guillotine blade, such as in order to provide for efficient and effortless incising/separating of the associated stack of CD's/DVD's or other supported disks.

A pair of side pillars 158 and 160 are integrated upon the platform 152 on either side of the main/central body 154. The pillars define open upper end tubes which seat a pair of coil springs 162/164.

A vertically supported incising portion includes a "U" shaped body with sides 166 and 168 and an upper interconnecting top 170. A button shaped hand grip portion 172 is configured upon the top 170 and the sides 166/168 are seated in slidable fashion within the inner open diameter of each open upper end pillars 158/160 and so that the ends of they bias against the inserted coil springs 162/164 and are influenced upwardly in the manner depicted in FIG. 15.

A serrated blade is shown at 174 and can include angled sides which terminate in a pointed tip 176. As with the previous version of the blade shown at 96, the blade edges can include any serrated or other configuration. As further best shown in FIG. 15, an upper edge aperture pattern is shown at 178 (four holes) configured in a base of the blade 174 and, upon installing the blade upwardly within recessed interior edges defined in the sides 166 and 168 (see at 180 for selected side 166), the aperture pattern 178 is aligned with an arrangement of mounting holes 182 configured on each side 166 and 168 of the upper displaceable body. A plurality of pin fasteners 184 install through the aligning apertures to mount the blade 174 to the upper interior of the U shaped vertically displaceable body.

Alternative to the disk support tray and insert cartridge of the first embodiment 10, the alternate embodiment 150 provides a pair of semi-circular shaped and pivotal support portions 186 and 188. As further assisted by the cutaway views of FIGS. 19A-19B, the disk support portions 186/188 are pivotally supported at base underside locations (see at 190 and 192 in FIG. 21) to inside recess or aperture mount locations (one of which is shown at 189) defined in the inside facing surfaces of the main portion 154.

Pairs of activating tabs 191 and 193 are supported upon inner opposing locations of the sides 166 and 168 of the "U" shaped upper and downwardly actuating handle (the exploded part view best illustrates a pair of spaced apart tabs 193 associated with the second side 168 of the "U" shaped handle). Upon the handle being depressed downwardly, the pairs of tabs 191/193 and caused to descend between the split side edges 155/155' of the main body portion 154 (and depending upon the configuration of the main base 154 to continue a limited downward motion within the communicating vertical notches 189), such that continued depression of the handle (see again each of FIGS. 20A and 20B), results in the pairs of tabs 191/193 engaging the disk support portions 186/188 proximate their opposite base edges offset from their pivotal mounting locations 190/192, this in order to pivot the disk support portions downwardly about their pivot locations 190/192. In this fashion, the disk support portions are rotated to their downward positions as depicted by the multiple positions referenced in FIG. 19B and their downward most rotated position as shown at 186' in FIG. 20B) in order to allow the sectioned pieces of the disk 2' to descend into the bottom chamber.

A pair of torsional springs 194 and 194' are provided and support the semi-circular portions 186/188 in an upwardly biasing direction when mounted within the central interior of the main vertical body portion 154. In one non-limiting variant, the opposite base edges of the disk support portions 186/188 are protruded in aligning fashion and resistively fit into the inside recess or aperture mounting locations 194 so that the disk support portions or wings are influenced upwardly in the position of FIG. 19A and, upon downward depressing of the upper "U" shaped body and blade, are counter rotated when contacted by the downwardly descending pairs of engaging tabs 191/193 against the biasing force of the torsional springs 194/194', in combination with the downward incising force of the blade 174 against the disk 2.

A removable bottom pad 196 is provided (see also attachment clips 198 in FIG. 21) and, upon the disk being fractured into pieces and descending from the downwardly pivoted support portions 186/188 into the lower interior of the main body 154, the bottom pad is removed to allow emptying from a bottom most collection chamber 200 of the sectioned disk portions.

During incising, the tip 176 of the blade 174 descends into initial contact against the inner rim profile of the central mounting hole of a given disk 2, this further assisting in position-ally supporting each of the disks within any tray supporting stack if incising more than one disk at a time. It is further understood that the present invention is not limited to the configuration of the incising device shown and which can also include other variations of a displaceable guillotine blade which effectively intersects and severs any plurality of stacked disks in a fashion to render efficient the ability to accomplish easy document destruction.

Figure 17:
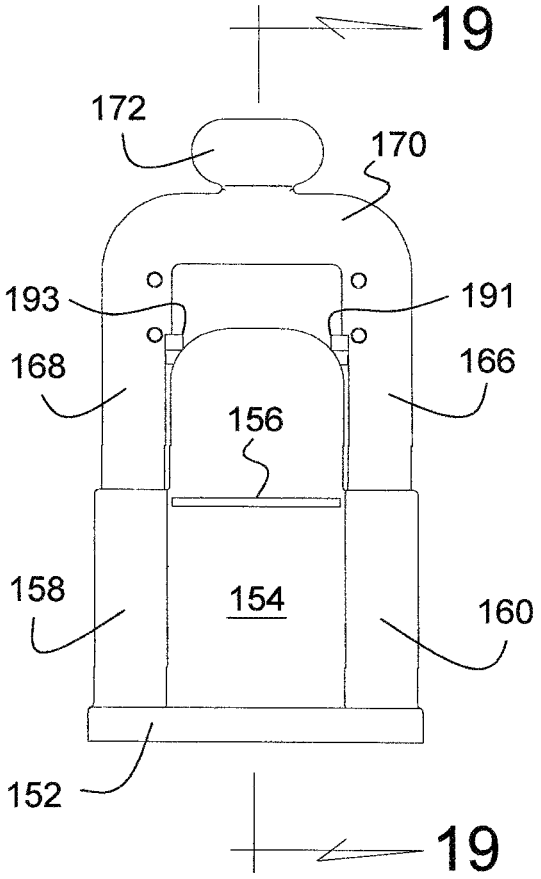
FIG. 17 is a front view of the device of FIG. 15.

FIG. 19A again depicts a cutaway view taken along line 19-19 of FIG. 17 and showing the handle (sides 166/168 and interconnected top 170) and blade 174 in a pre-incising position with the pair of pivotally supporting disk tray/shelf supports 186/188 depicted in an initial disk supporting position. FIG. 19B is a succeeding view to FIG. 19A and subsequently depicting the handle and blade in a downwardly vertically displacing and post-incising position for severing the disk into first and second portions, the pair of pivotal shelf supports 186/188 being concurrently pivoting and/or displacing as shown in a downward direction by the action of the blade, this countering the return upward bias of the torsional spring mounts 194/194', in order to release the fractured disk halves for falling to the bottom collection chamber 200 of the body interior.

Figure 18:
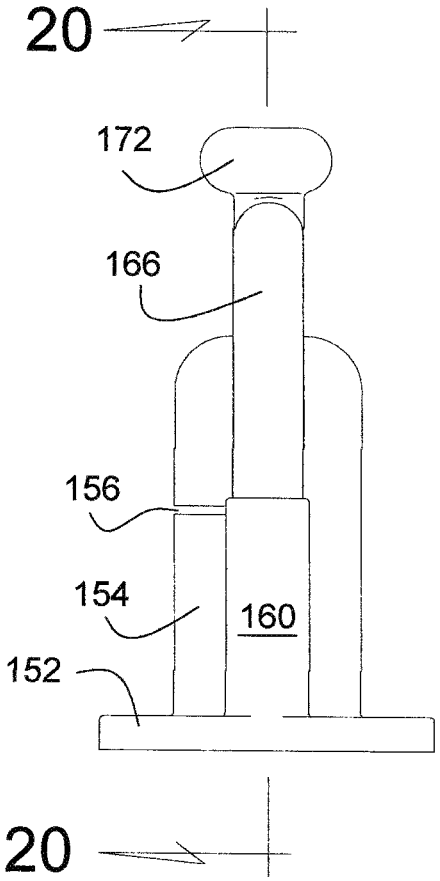
FIG. 18 is a side view of the device of FIG. 15.
Figure 19A:
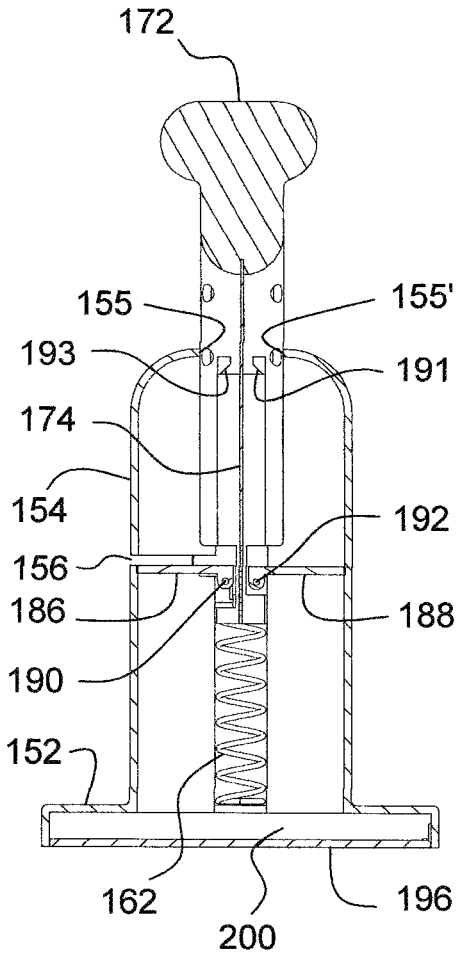
FIG. 19A is a cutaway view taken along line 19-19 of FIG. 17 and showing the handle and blade in a pre-incising position with a pair of pivotally supporting disk tray/shelf supports depicted in an initial disk supporting position.
Figure 19B:
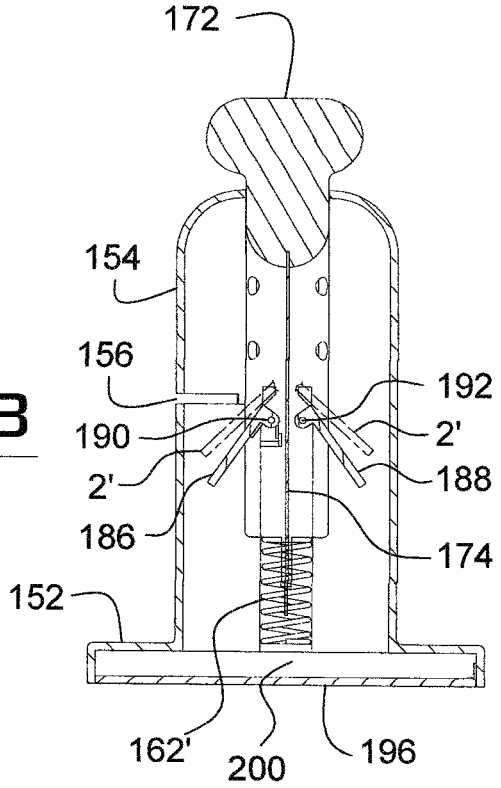
FIG. 19B is a succeeding view to FIG. 19A depicting the handle and blade in a downwardly displacing and post-incising position for severing the disk into first and second portions, the pair of pivotal shelf supports pivoting downwardly to release fractured disk halves into the lower collection tray.
Figure 20A:
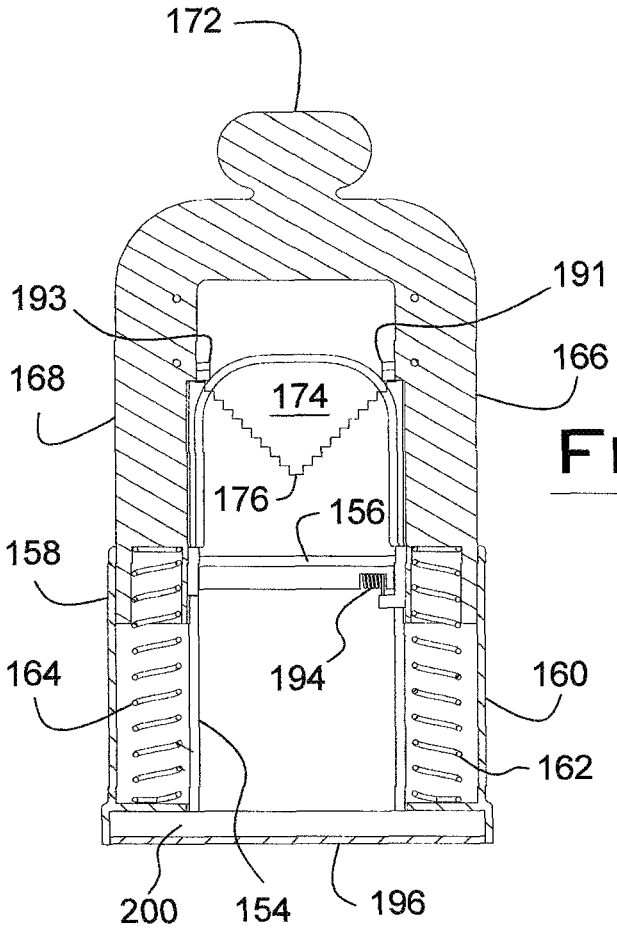
FIG. 20A is a cutaway view taken along line 20-20 of FIG. 18 and depicting the handle, blade and pivotal disk support tray/shelf supports in the position of FIGS. 17 and 19A.
Figure 20B:
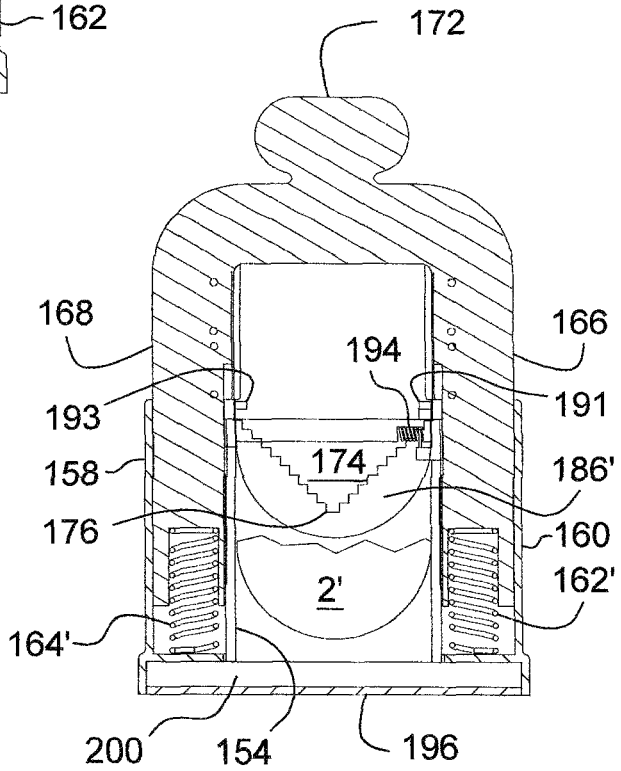
FIG. 20B is a succeeding view of FIG. 20A and depicting the handle, blade and disk support tray/shelf supports in the incised and release position of FIG. 19B.
Figure 21:
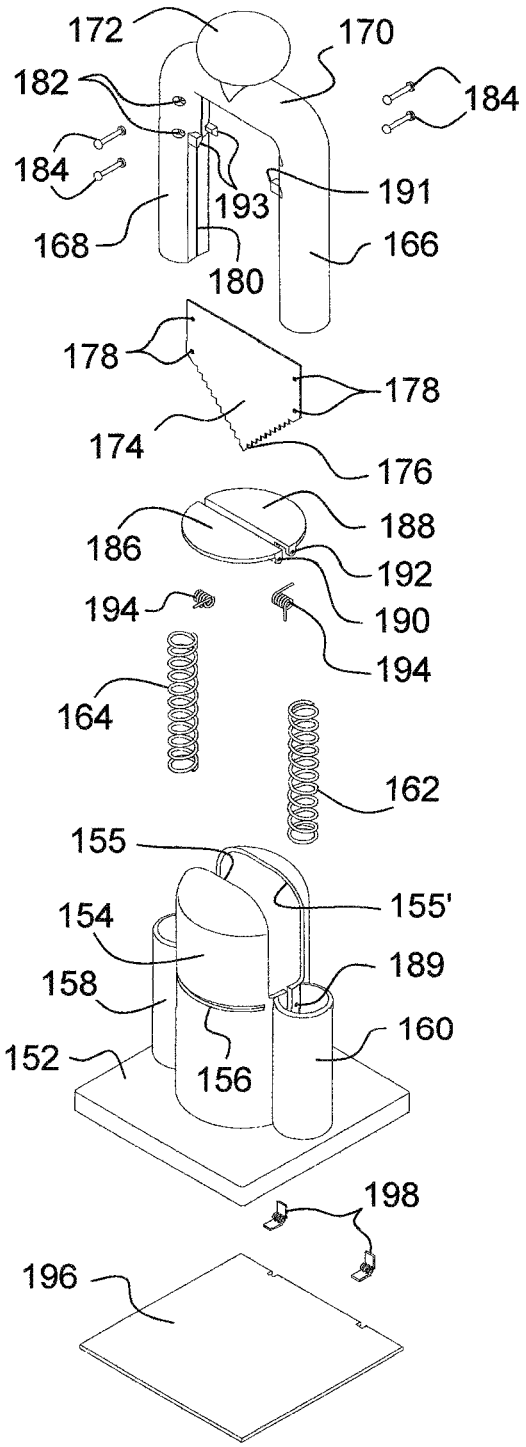
FIG. 21 is an exploded parts list view of the disk destruction device of FIG. 15.

FIG. 20A is a cutaway view taken along line 20-20 of FIG. 18 and depicting the handle, blade and pivotal disk support tray/shelf supports in the position of FIGS. 17 and 19A. Finally, FIG. 20B is a succeeding view of FIG. 20A and depicting the handle, blade and disk support tray/shelf supports in the incised and release position of FIG. 19B;

Having described my invention, other and additional preferred embodiments will become apparent to those skilled in the art to which it pertains, and without deviating from the scope of the appended claims. This can again include repositioning the disk storage tray to an intermediate interior location of the main three dimensional body, such that a receiving magazine incorporated into the body can receive up to a set number of the disks inserted sideways with the severed remnants following incising being easily removed or emptied.

Additional variants of the present invention further contemplate incorporating any type of lever or force multiplier for increase the downward driving force of the guillotine blade and thereby in order to section or incise greater stacked pluralities of disks. The handle may further be spring loaded in order to be normally biased in an upward/separating direction between incising events. Additionally, the blade configuration may further be revised, from that shown, in order to accommodate different designs afforded to the main body and the interior extending passageway.

I claim:

1. A destruction device for sectioning and destroying a digital data carrying disk, said device comprising:

a body having an extending passageway defined therein;

a support portion positioned inside said body adapted for supporting the disk relative to the passageway prior to incising;

a handle mounting a blade, said handle being guidably supported relative to said body for displacing said blade within said passageway for incising the disks;

said support portion further including a cartridge adapted to installing the disk within said body, said cartridge further including a pair of split and laterally separable portions; and said handle being pivotally supported to said body, a displacing component supported upon said cartridge and, upon downwardly pivoting said handle, said displacing component separating said pair of split and laterally separable portions to permit said blade to section the disk.

2. The device as described in claim 1, further comprising a collection tray at a lower interior of said body.

3. The device as described in claim 2, said collection tray further comprising a removable and depth defining drawer.

4. The device as described in claim 1, said support portion further comprising a linkage arm pivotally supported within said body.

5. The device as described in claim 1, said blade further comprising a serrated edge.

6. The device as described in claim 1, said blade further comprising first and second angled sides.

7. A destruction device for sectioning and destroying a digital data carrying disk, said device comprising:

a body defining an interior enclosure;

a cartridge contained within a first location of said body and adapted to receive the disk in a first loading position;

a handle mounting a blade, said handle displacing said blade along a passageway extending within said body and through said cartridge for incising the disk;

said cartridge further including a pair of split and laterally separable portions;

said handle being pivotally supported to a bracket mounted to an upper location of said body, a displacing component supported upon said cartridge and, upon downwardly pivoting said handle, said displacing component separating said pair of split and laterally separable portions to permit said blade to section the disk; and a collection receptacle located below said cartridge and adapted for collecting incised portions of the disk.

8. The device as described in claim 7, further comprising a pair of biased linkage arms supporting said cartridge and disk during actuation of said handle and blade.

9. The device as described in claim 7, further comprising a lid attached upon said body, a superstructure of said lid defining a slot from which extends said handle.

* * * * *